United States Patent [19]

Morris

[11] 4,201,136

[45] May 6, 1980

[54] SAFETY CONTROL FOR ELECTRONIC CIRCUITS

[75] Inventor: George V. Morris, Chicago, Ill.

[73] Assignee: The United States of America as represented by the Secretary of the Army, Washington, D.C.

[21] Appl. No.: 206,756

[22] Filed: Jan. 19, 1951

[51] Int. Cl.[2] ..... F42B 13/04

[52] U.S. Cl. ..... 102/214; 102/208

[58] Field of Search ..... 102/70.2, 70.2 G, 70.2 P

[56] References Cited

U.S. PATENT DOCUMENTS 2,984,183 5/1961 Hopper ..... 102/214

*Primary Examiner*—Verlin R. Pendegrass

*Attorney, Agent, or Firm*—Nathan Edelberg; Robert P. Gibson; Saul Elbaum

EXEMPLARY CLAIM

1. An electronic control circuit, a plate supply for said circuit, an electronic grid-controlled power tube controlled through its grid by the output of said control circuit, a translating device energized by said power tube in response to the output of said control circuit, a condenser connected to serve as a plate supply source for said power tube, circuit connections for charging said condenser from said first plate supply, an unsymmetrical resistance in said circuit connections arranged to offer a high impedance to passage of charging current from said first plate supply to said condenser, but to offer low impedance to discharge of said condenser into the plate supply, whereby upon reduction of said plate supply voltage below a safe operating level, said condenser voltage will be rapidly reduced to a value below the operating value.

3 Claims, 2 Drawing Figures

SAFETY CONTROL FOR ELECTRONIC CIRCUITS

This invention relates to a safety arrangement for electronic control circuits, and in particular to that type of electronic circuits wherein a control signal triggers the effective discharge of a final stage to energize a translating device.

The primary object of the invention is to prevent premature discharge of the final stage of a control device upon failure of the voltage supply to the preceding stages. Another object is to provide a condenser storage element as a power supply for the final stage of an electronic control circuit. It is also an object of this invention to render safe an electronic control circuit terminating in a trigger stage so that an initial pulse in the control circuit due to closing a switch to apply power to said circuit will not prematurely actuate said trigger stage.

A specific embodiment of this invention will be shown in connection with an electric proximity fuse wherein the control circuit operates in response to the presence of a target object and the trigger circuit is actuated to set off a detonator to detonate an explosive charge.

Figure 1:
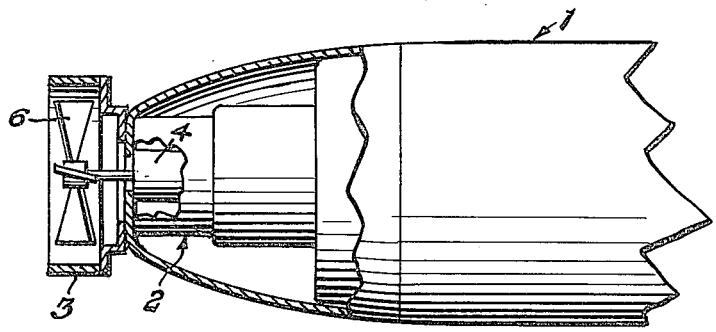

The specific nature of the invention as well as other objects and advantages thereof will clearly appear from a description of a preferred embodiment as shown in the accompanying drawings, in which FIG. 1 is a schematic view of a projectile having an electric fuse to which this invention is applicable.

Figure 2:
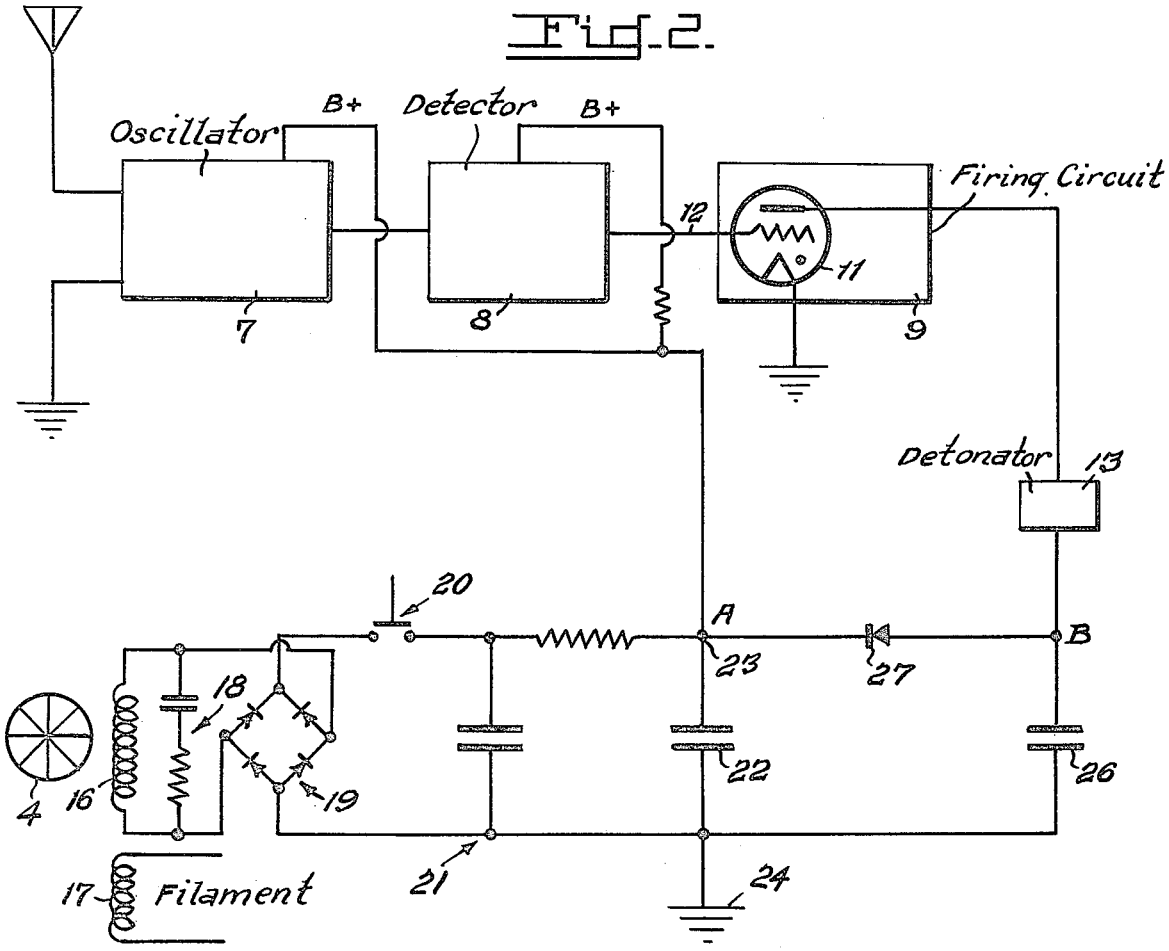

FIG. 2 is a schematic circuit diagram of a control circuit embodying the invention.

Referring to the drawings, a projectile 1 is indicated as having a proximity fuse 2 mounted in its nose. This fuse is provided with an antenna 3 for radiating energy, which is reflected from any nearby target object to provide a signal which is used in known fashion to explode the projectile. One known type of fuse is powered by a small generator 4 driven by a wind vane 6 usually mounted in or near the nose of the projectile. The fuse circuit comprises an oscillator stage generally indicated at 7 in FIG. 2, a detector stage generally indicated at 8, and a trigger stage generally indicated at 9. In the arrangement shown, the trigger stage includes a thyratron tube 11, the grid of which is normally negatively biased to prevent discharge between the plate and cathode, in conventional fashion. The preceding stages 7 and 8 are so arranged that the presence of a target will cause a signal to be emitted from stage 8 in the form of a positive pulse on wire 12 which will remove the negative grid bias to permit the thyratron to discharge and thus fire detonator 13; this is in accordance with known practice and forms no part of my invention.

Power supply for the above circuit is furnished by a small generator driven by wind vane 6. This generator is schematically indicated in FIG. 2 as comprising a rotor 4 and stator windings 16 and 17 in which plate and filament voltages are respectively induced by rotation of rotor 14. The plate supply voltage appearing across winding 16 and regulator elements 18 is rectified by a conventional rectifier 19 and filtered by a conventional filter arrangement indicated at 21 and including condenser 22. The plate voltage for stages 7 and 8 is taken off from point 23 of condenser 22. The other side of said condenser is suitably grounded as at 24. A separate source of plate voltage is provided for the thyratron of the final stage. This comprises condenser 26 which is fed from point 23 through asymmetric resistance 27 in the direction of least conductivity. The condenser must, of course, be of sufficient capacity to fire the detonator. Element 27 may be an ordinary selenium rectifier element whose resistance in the direction of least conductivity is selected to give a suitably slow charging time to the RC combination of resistance 27 and condenser 26, so that the condenser will not be charged to full operating value until the preceding stages have reached a stable operating condition. In this manner the detonator stage is rendered safe against pulses, transients, and other abnormal operating conditions which are likely to be present immediately after stages 7 and 8 have been energized. It will be understood that in practice safety arming devices (indicated schematically by switch 20) are provided so that the electric power supply circuit is not closed until a definite time after the projectile is discharged. The sudden closing of the circuit at this time, or at any time, is likely to cause premature firing of the fuse as the full plate voltage is suddenly applied to the thyratron. The present arrangement obviates this possibility.

A difficulty arises, however, in the event that, for any reason, the voltage supply should fail or be reduced rapidly to the point where the oscillator stage ceases to oscillate; then the negative bias may be removed from the thyratron while the plate voltage furnished by condenser 26 may still be at a sufficiently high level to cause the thyratron to fire and thus detonate the projectile. This is possible if a conventional resistance element is employed in the RC charging circuit, because the time delay required to discharge the circuit will be as great as that required to charge it. However, by employing asymmetric resistance element 27, the condenser will discharge so rapidly that its voltage will closely follow fluctuations or reduction in the supply voltage and the type of premature firing above described cannot occur. This, of course, is due to the fact that rectifier 27 has a low resistance in the direction of discharge of the condenser.

The above difficulty is particularly likely to occur in the case of mortar shells or other high-trajectory projectiles near the apex of flight because the velocity of the projectile at this point is often reduced sufficiently so that not enough voltage is generated by the wind vane to maintain oscillation. By using the asymmetric resistance element 27, as shown, not only is this danger prevented but also premature firing because of any failure or reduction in the plate voltage for any reason whatsoever.

It will be noted that the time delay in the charging direction of the thyratron supply condenser 26 will be made sufficiently long so that proper firing voltage is not obtained until a safe time interval has elapsed. In the event that a triggering signal is received from any source whatever before the thyratron condenser is fully charged, the characteristics of the thyratron are such that a low-order discharge of sufficient value will be produced to completely discharge condenser 26, but of insufficient value to set off the detonator 13.

It will be apparent that this invention is not restricted to circuits in which the thyratron is employed in the final stage but may be employed with any other suitable type of electric tube used in a triggering circuit.

It will be apparent that the embodiments shown are only exemplary and that various modifications can be made in construction and arrangement within the scope of my invention as defined in the appended claims.

I claim:

1. An electronic control circuit, a plate supply for said circuit, an electronic grid-controlled power tube controlled through its grid by the output of said control circuit, a translating device energize by said power tube in response to the output of said control circuit, a condenser connected to serve as a plate supply source for said power tube, circuit connections for charging said condenser from said plate supply, an unsymmetrical resistance in said circuit connections arranged to offer a high impedance to passage of charging current from said first plate supply to said condenser, but to offer low impedance to discharge of said condenser into the plate supply, whereby upon reduction of said plate supply voltage below a safe operating level, said condenser voltage will be rapidly reduced to a value below the operating value.

2. Safety firing control for an electronic proximity fuse circuit having a grid-controlled thyratron tube actuated by a predetermined positive grid signal to energize a detonator, comprising a plate voltage supply for said electronic circuit, a condenser, an unsymmetrical resistance said condenser connected cross said voltage supply through said unsymmetrical resistance electrically so oriented as to present a high resistance to current flow from said voltage supply to said condenser and a low resistance to current flow in the opposite direction, whereby said condenser is slowly charged to the value of said voltage supply when the latter is normally energized, but rapidly discharges into the voltage supply when the latter is lower than said normal energization level, and a lead from the positive side of said condenser to the plate circuit of said thyratron.

3. Safety firing control for an electric proximity fuse circuit having a signal transmitting oscillator, a signal-sensitive detector, a grid-controlled thyratron tube controlled by the output of said oscillator and detector, and a detonator controlled by said thyratron, comprising an alternating current power supply providing a source of plate voltage for said circuit components, a rectifier and filter for said power supply terminating in a condenser element one side of which is connected to ground of said circuit and one side to the plate supply of said oscillator and detector circuits, a second condenser in parallel with said first condenser, an unsymmetrical resistance element in the circuit between said two condensers so oriented as to present a high resistance to current flow from said first condenser to said second condenser, and a low resistance to current-flow in the opposite direction, whereby said first condenser slowly charges said second condenser when said source of plate voltage is energized, but said second condenser rapidly discharges into said filter circuit when said source of plate voltage is deenergized, and a lead from the positive side of said last condenser to the plate circuit of said thyratron.

* * * * *